US008955181B2

(12) United States Patent
Kelly

(10) Patent No.: US 8,955,181 B2
(45) Date of Patent: Feb. 17, 2015

(54) DIAPERING RESTRAINT

(76) Inventor: Erin Shigeko Uyeda Kelly, Los Angeles, CA (US)

( * ) Notice: Subject to any disclaimer, the term of this patent is extended or adjusted under 35 U.S.C. 154(b) by 0 days.

(21) Appl. No.: 13/982,590

(22) PCT Filed: Jan. 31, 2012

(86) PCT No.: PCT/US2012/023339
§ 371 (c)(1),
(2), (4) Date: Jul. 30, 2013

(87) PCT Pub. No.: WO2012/109058
PCT Pub. Date: Aug. 16, 2012

(65) Prior Publication Data

US 2013/0312198 A1 Nov. 28, 2013

Related U.S. Application Data

(60) Provisional application No. 61/440,584, filed on Feb. 8, 2011.

(51) Int. Cl.
*A47D 5/00* (2006.01)
*A47D 15/00* (2006.01)

(52) U.S. Cl.
CPC ..... *A47D 5/00* (2013.01); *A47D 15/008* (2013.01)
USPC ..... 5/655; 128/869; 128/875; 128/874

(58) Field of Classification Search
USPC ..... 5/655; 128/869, 874, 875
See application file for complete search history.

(56) References Cited

U.S. PATENT DOCUMENTS

| | | | | | |
|---|---|---|---|---|---|
| 2,693,177 | A | * | 11/1954 | Barstow | 128/874 |
| 2,863,450 | A | * | 12/1958 | Johnson | 128/874 |
| 2,940,443 | A | * | 6/1960 | Baker | 128/874 |
| 3,136,311 | A | * | 6/1964 | Lewis | 128/874 |
| 3,136,581 | A | * | 6/1964 | Caballero | 297/465 |
| 3,265,065 | A | * | 8/1966 | Jillson | 128/874 |
| 3,987,505 | A | * | 10/1976 | Hickey | 2/114 |
| D275,230 | S | * | 8/1984 | Hubbard et al. | D24/190 |
| 4,608,973 | A | * | 9/1986 | Green et al. | 128/874 |
| 5,274,851 | A | * | 1/1994 | Simpkins et al. | 2/102 |
| 6,681,422 | B2 | * | 1/2004 | Landry | 5/494 |
| 8,117,698 | B1 | * | 2/2012 | Khaze Harry | 5/655 |
| 8,245,338 | B1 | * | 8/2012 | Nemeth | 5/655 |

* cited by examiner

*Primary Examiner* — Robert G Santos
*Assistant Examiner* — Ifeolu Abedoyejo
(74) *Attorney, Agent, or Firm* — The Law Firm of Andrea Hence Evans, LLC

(57) ABSTRACT

A child restraint device for use with a changing surface for diapering a child, which includes a rear panel, two vest flaps each attached to the rear panel, and two affixing flaps for securing the rear panel to the changing surface. Each of the two vest flap has a multiple-sided shape with a first side attached to a top edge of the rear panel, a third side attached to a side edge of the rear panel, and a second side between the first and third side forming an arm opening. The attachment locations of the two flaps to the top edge of the rear panel are spaced apart from each other for accommodating the head of the child. The two vest flaps include means for attaching them together.

12 Claims, 3 Drawing Sheets

DIAPERING RESTRAINT

BACKGROUND OF THE INVENTION

1. Field of the Invention

The present invention relates generally to a personal restraint device. More particularly, the present invention relates to a personal restraint device for use on a child during the process of changing the child's diaper.

2. Description of the Related Art

A number of diapering restraints have been previously described. The majority of such previously described restraints generally fall into two categories—those utilizing a single torso strap and those utilizing multiple, elongated straps to achieve a four-point restraint system. A single strap device, while sometimes capable of reducing the risk of fall from the changing surface, often fails to prevent rolling within the loop created by the strap. These single strap devices also allow the child to sit up if the strap is placed, or the child moves to such a position that places the strap, near or below the waist of the child. While a four-point restraint system is much more effective at limiting a child's movement, these systems often present an inherently dangerous situation as the multiple, narrow, elongated straps provide an opportunity for a child to become entrapped or strangled. In addition to the hazard posed by devices that utilize straps, the straps make for a complicated process of applying the device to the infant. Most restraints include four separate straps that must be combined in a specific configuration, often requiring the various straps to be applied in a specific sequence in order to effectively restrain the child. This is inefficient and often confusing for a caregiver who is already struggling with an active and/or resistant child.

SUMMARY OF THE INVENTION

The present invention is a restraint device used for the purpose of restricting the movement of a child during the diaper changing process. Embodiments of the present invention utilize two vest-like flaps that are affixed to the diaper changing surface and secured to one another via a hook-and-loop attachment.

An object of the present invention is to provide a diapering restraint device that is easy and safe to use.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a child restraint device for use with a changing surface for diapering a child, which includes: a rear panel; a first vest flap and a second vest flap each attached to the rear panel; wherein the first vest flap has a multiple-sided shape with a first side attached to a top edge of the rear panel, a third side attached to a first side edge of the rear panel, and a second side between the first and third side forming an arm opening, wherein the second vest flap has a multiple-sided shape with a first side attached to the top edge of the rear panel, a third side attached to a second side edge of the rear panel, and a second side between the first and third side forming an arm opening, wherein the attachment location of the first vest flap to the top edge of the rear panel and the attachment location of the second vest flap to the top edge of the rear panel are spaced apart from each other for accommodating a head of the child, and wherein the first and second vest flaps include means for attaching the first and second vest flaps together; and means for securing the rear panel to the changing surface.

In another aspect, the present invention provides a child restraint device for diapering a child, which includes: a changing surface; a first vest flap and a second vest flap each attached to the changing surface; wherein the first vest flap has a multiple-sided shape with a first side attached to the changing surface along a transverse line of the changing surface, a third side attached to the changing surface along a first longitudinal line of the changing surface, and a second side between the first and third side forming an arm opening, wherein the second vest flap has a multiple-sided shape with a first side attached to the changing surface along the transverse line of the changing surface, a third side attached to the changing surface along a second longitudinal line of the changing surface, and a second side between the first and third side forming an arm opening, wherein the attachment locations of the first and second vest flaps along the transverse line of the changing surface are spaced apart from each other for accommodating a head of the child, and wherein the first and second vest flaps include means for attaching the first and second vest flaps together.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
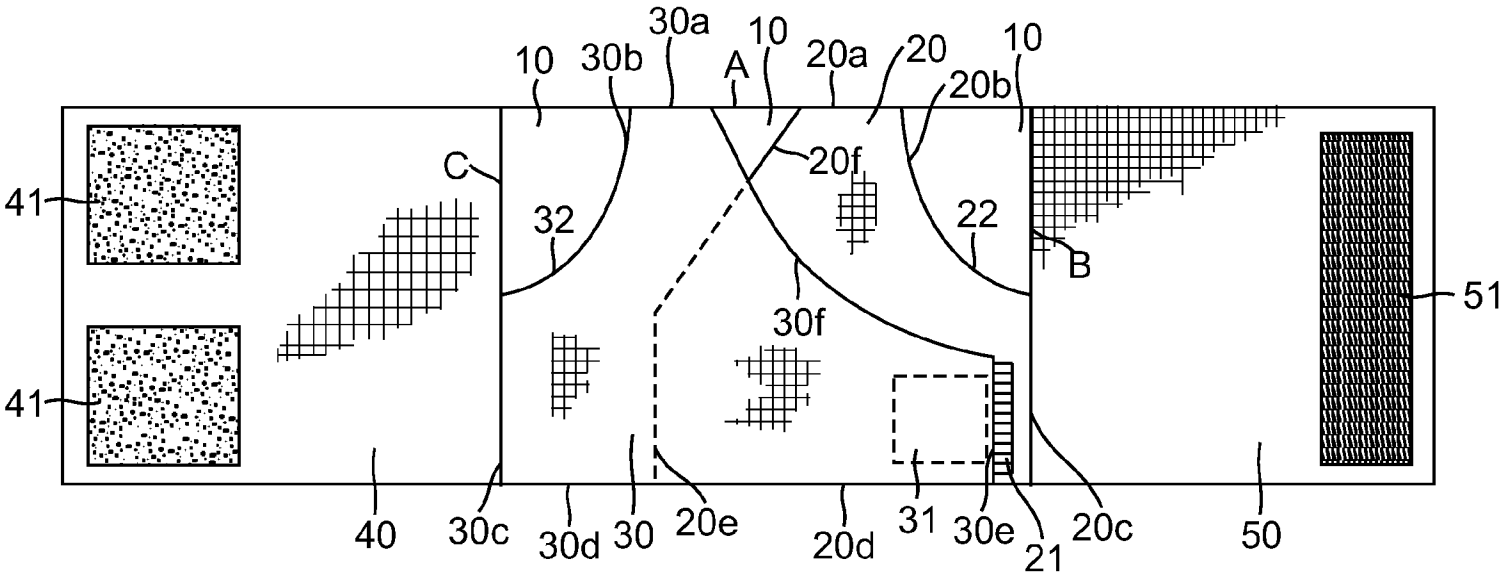
FIG. 1 is a top plan view of a restraint device according to a preferred embodiment of the present invention.

Referring now to embodiments of the invention in more detail, in FIG. 1 there is shown a restraint device (1) in a preferred embodiment having a rear panel (10), a first vest flap (20), a second vest flap (30), a first affixing flap (40) and a second affixing flap (50). The device (1) is made of fabric materials (including mesh), and may be made by stitching multiple pieces of fabric materials (same or different types of fabric) together.

A first arm opening (22) is created by the attachment of the first vest flap (20) at the top edge (A) of rear panel (10) and a first side edge (B) of rear panel (10). A second arm opening (32) is similarly created by the attachment of second vest flap (30) to top edge (A) and a second side edge (C) of rear panel (10) which is opposite the first side edge (B). The attachment locations of the first vest flap (20) on the top edge (A) and on the side edge (B) are on one side of a longitudinal centerline of the rear panel (10); the attachment locations of the second vest flap (30) on the top edge (A) and the side edge (C) are on the other side of the longitudinal centerline (the longitudinal direction is the up-down direction in FIG. 1). The two attachment locations of the first and second vest flaps (20, 30) to the top edge (A) are spaced apart from each other to accommodate the head of the child.

Generally speaking, as shown in FIG. 1, each vest flap (20 or 30) has a six-sided shape. The first side (20*a*, 30*a*) is attached to the top edge (A) of the rear panel (10); the third side (20*c*, 30*c*) is attached to the side edge (B or C) of the rear panel (10); the second side (20*b*, 30*b*) is located between the first and third side to form the arm opening; the fourth side (20*d*, 30*d*) is aligned with the bottom edge of the rear panel (10); the sixth side (20*f*, 30*f*) runs from the top edge (A) down in a generally diagonal direction crossing the longitudinal center line of the rear panel (10); and the fifth side (20*e*, 30*e*) is located between the fourth side and the sixth side. Preferably, the first, third and fourth sides are straight, while the second side is curved to form a suitable arm opening. The shapes of the fifth and sixth sides are not important; in fact, these two sides may be shaped in a smooth curve.

In the embodiment shown in FIG. 1, the rear panel (10) is generally rectangular shaped. Alternatively, the rear panel (10) may have different shapes. For example, it may have the two upper corners cut in a shape corresponding to the shape of the arm openings of the first and second vest flaps (20, 30).

Figure 4:
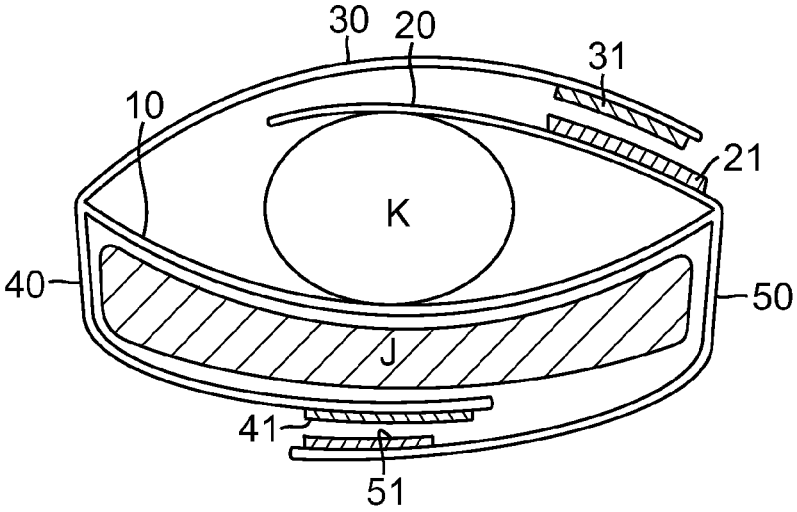
FIG. 4 is a cross-sectional view of the embodiment of FIG. 1 taken along line 4-4 of FIG. 3.
Figure 3:
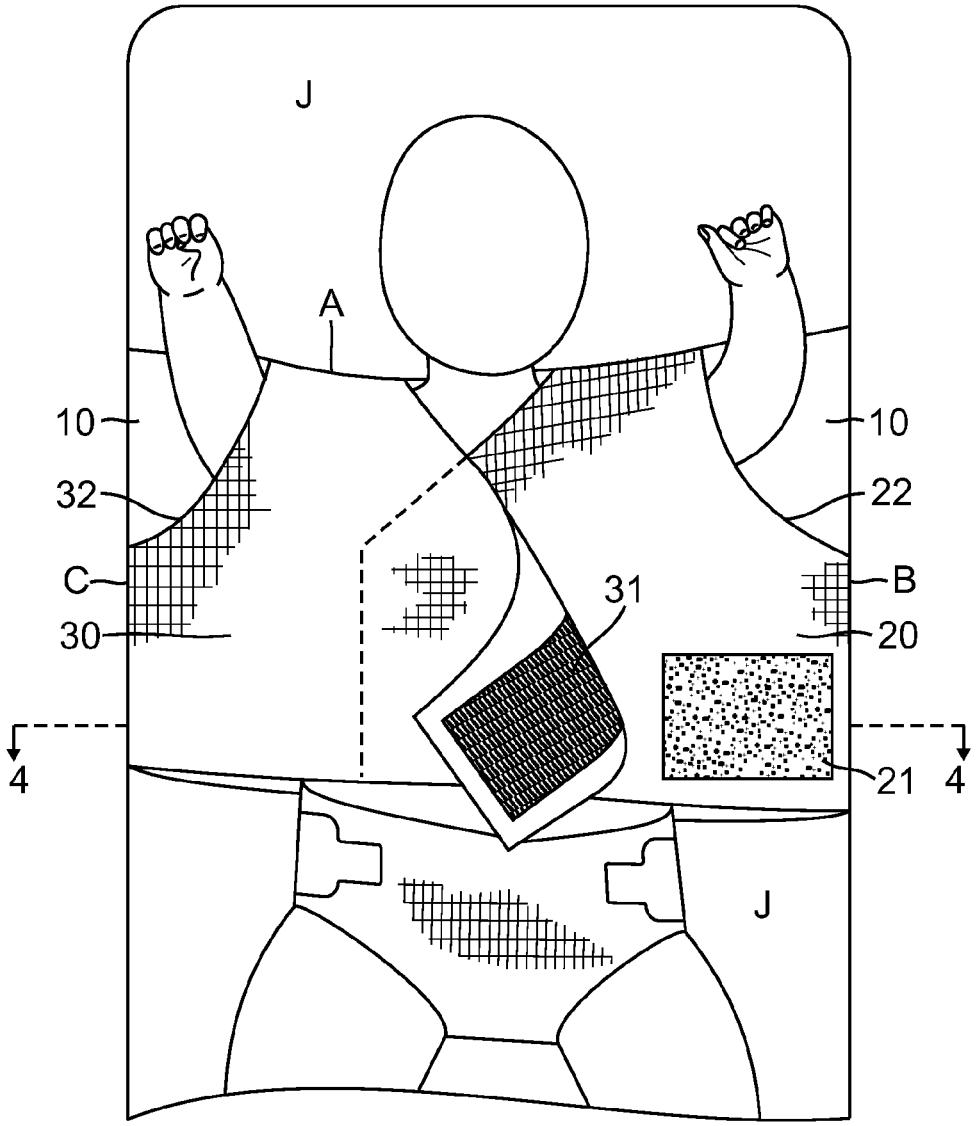
FIG. 3 is a top plan view of the embodiment of FIG. 1, shown mounted on a changing pad and holding a child.

FIG. 1 depicts the preferred embodiment of the invention with the vest flaps (20, 30) in a closed configuration having the first vest flap (20) secured to the second vest flap (30) via complementary hook and loop surfaces (21, 31), with one such surface (21) located on the front of the first vest flap (20), and the other such surface (31) located on the back of the second vest flap (30) (see also FIGS. 3 and 4).

Figure 2:
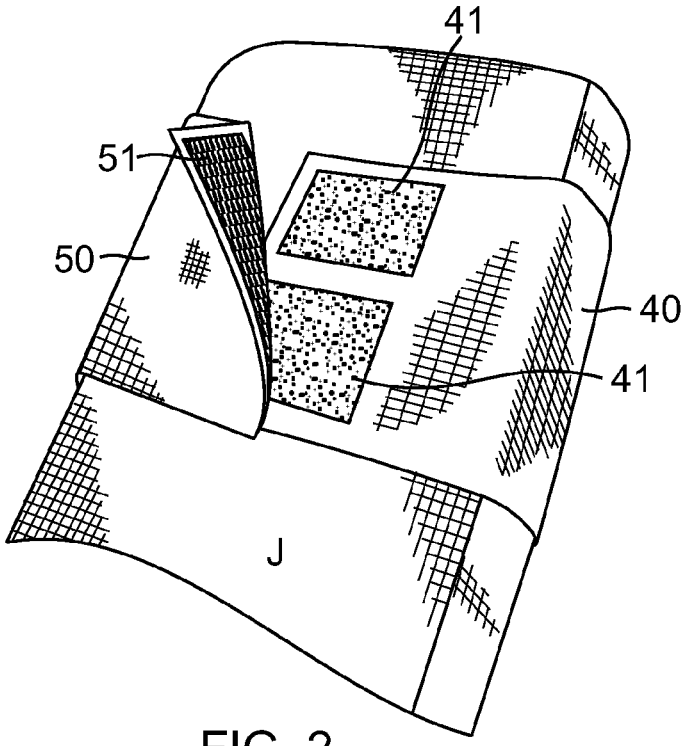
FIG. 2 is an isometric view of the embodiment of FIG. 1 being fastened on the underside of a changing pad.

As shown in FIG. 1, the first and second affixing flaps (40, 50) are attached to the rear panel (10) along the side edges (C and B), respectively. As shown in FIG. 2, and also demonstrated in FIG. 4, the device can be fastened around a stable changing surface (J), such as a standard, contoured changing pad, via complementary hook and loop surfaces (41, 51) located at the ends of the first and second affixing flaps (40, 50).

In the illustrated embodiment (FIG. 1), the affixing flaps (40, 50) are generally rectangular in shape and are attached to the rear panel (10) along the entire lengths of the edges (C, B). In an alternative embodiment (not shown), the affixing flaps (40, 50) may have a tapered shape so the free ends near the hook and loop surfaces (41, 51) are shorter than the ends that are attached to the rear panel (10). In another embodiment, the affixing flaps (40, 50) are attached to the side edges (C, B) along part of their lengths. In another embodiment (not shown), each affixing flap may include multiple affixing bands attached to the rear panel (10) along an edge (C or B) at multiple locations.

In the illustrated embodiment (FIG. 2), the ends of the first and second affixing flaps (40, 50) are attached to each other by the hook and loop surfaces (41, 51) whereby the restraint device (1) is wrapped around and secured to the changing pad (J). In an alternative embodiment (not shown), each end of the first and second affixing flaps (40, 50) is attached directly to the back side of the changing pad (J) by hook and loop surfaces.

In another alternative embodiment (not shown), the device (1) may be constructed with a continuous affixing loop having the circumference approximately equal to that of the changing pad (J). This may be thought of as having the two affixing flaps (40, 50) permanently jointed to each other. The changing pad (J) can then pass through the affixing loop and the restraint can be positioned appropriately to receive a child.

In yet another alternative embodiment, the affixing flaps (40, 50) are eliminated; rather, other means of securing the rear panel (10) to the changing pad (J) are provided, such as hook and loop surfaces located on the back of the rear panel (10) and the front side of the changing pad (J) to directly attach the rear panel to the front side of the changing pad (J).

In addition to the various means described above, other suitable means may be used to secure the rear panel (10) to the changing surface. Several types of changing surfaces are commonly used—standard-size, contoured changing pads; plastic, wall-mounted changing boards (as commonly found in public restrooms); oversized dresser top pads; etc.—and different affixing means may be suitable for different kinds of surfaces. For example, if a standard width, contoured changing pad is being used, some form of affixing flaps will easily secure the restraint to the changing pad; however, if the changing surface is very large, such as an oversized pad used on a dresser top, it may be preferable to directly attach the rear panel (10) to the changing surface as a very large changing surface would require excessively long affixing flaps. The embodiment shown in FIGS. 1, 2 and 4 is preferred because it accommodates the most commonly used changing pads and is flexible and easy to use.

In yet another alternative embodiment, the rear panel (10) is eliminated, and the vest flaps (20, 30) are directly attached to the changing surface at the locations that they would have been attached to the rear panel (10), forming the arm openings and the space for accommodating the head. In other words, the first sides (20*a*, 30*a*) of the first and second vest flaps are attached to the changing surface along a transverse line where the top edge of the rear panel (10) would have been, the third sides (20*c*, 30*c*) of the of the first and second vest flaps are attached to the changing surface along two transverse lines where the two side edges of the rear panel would have been, and the fourth sides (20*d*, 30*d*) of the first and second vest flaps are aligned along a transverse line where the bottom edge of the rear panel (10) would have been.

In the descriptions above, complementary hook and loop surfaces are used at various places to attach two members to each other. As alternatives to hook and loop surfaces, other attaching means may be used to attach the two members to each other, such as snaps, buttons, zippers, strings, buckles, etc. Hook and loop surfaces are preferred because they are flat and easy to use.

Referring now to FIG. 3, the restraint device (1) is shown in use, secured to a changing pad (J) and holding a child. To position the child in the restraint, the first and second vest flaps (20, 30) are opened to reveal the rear panel (10). The child is then placed onto rear panel (10) in a supine position with shoulders approximately even with the top edge (A) of the restraint. The child's arms are then inserted into the first and second arm openings (22, 32). The first vest flap (20) is then laid across the child's torso. The second vest flap (30) is then similarly laid across the child's torso and over the first vest flap (20) such that hook and loop surface (31) of the second vest flap (30) overlaps with complimentary hook and loop surface (21) of first vest flap (20) to maintain the device in a closed position. Once closed, the device holds the child in a position that prevents him from rolling, sitting up or sliding on the changing pad. The child is also positioned such that there is unimpeded access to the diaper area and the child's legs are free to be lifted as needed to facilitate diaper removal, cleaning, application of ointments or other diaper area treatments and for positioning and securing of a clean diaper.

FIG. 4 provides a cross-sectional view of the device (1) shown wrapped around a changing pad (J) and holding the torso of a child (K). This figure illustrates the relative positions of the two vest flaps (20, 30), the rear panel (10) and the two affixing flaps (40, 50). Also illustrated in this figure is the overlapping nature of the hook and loop surfaces (21, 31) and (41, 51) which serve to fasten the vest flaps (20, 30) and affixing flaps (40, 50), respectively.

It will be apparent to those skilled in the art that various modification and variations can be made in the diapering restraint device of the present invention without departing from the spirit or scope of the invention. Thus, it is intended that the present invention cover modifications and variations that come within the scope of the appended claims and their equivalents.

What is claimed is:

1. A child restraint device for use with a changing surface for diapering a child, comprising:

a rear panel;

a first vest flap and a second vest flap each attached to the rear panel;

wherein the first vest flap has a multiple-sided shape with a first side attached to a top edge of the rear panel, a third side attached to a first side edge of the rear panel, and a second side between the first and third side forming an arm opening, wherein the second vest flap has a multiple-sided shape with a first side attached to the top edge of the rear panel, a third side attached to a second side edge of the rear panel, and a second side between the first and third side forming an arm opening, wherein the attachment location of the first vest flap is along the top edge of the rear panel and the attachment location of the second vest flap is along the top edge of the rear panel are spaced apart from each other for accommodating a head of the child, and wherein the first and second vest flaps include means for attaching the first and second vest flaps together; and wherein the means for securing the rear panel to the changing surface includes a first affixing flap and a second affixing flap attached to the first side edge and the second side edge of the rear panel, respectively, wherein the first and second affixing flaps include means for attaching the first and second affixing flaps together when the rear panel and the and second affixing flaps are wrapped around the changing surface; and means for securing the rear panel comprising a first affixing flap and a second affixing flap attached along the first side edge and along the second side edge of the rear panel, respectively, wherein the first and second affixing flaps include means for attaching the first and second affixing flaps together when the rear panel and the first and second affixing flaps are wrapped around the changing surface.

2. The child restraint device of claim 1, wherein each of the first and second vest flaps includes a fourth side aligned with a bottom edge of the rear panel.

3. The child restraint device of claim 1, wherein the rear panel, the first vest flap and the second vest flap are made of fabric materials.

4. The child restraint device of claim 1, wherein the rear panel has a rectangular shape.

5. The child restraint device of claim 1, wherein the means for attaching the first and second vest flaps together includes complementary hook and loop surfaces, snaps, buttons, zippers, strings, or buckles, located on the first and second vest flaps.

6. The child restraint device of claim 1, wherein the means for attaching the first and second affixing flaps together includes complementary hook and loop surfaces, snaps, buttons, zippers, strings, or buckles, located on the first and second affixing flaps.

7. The child restraint device of claim 1, wherein the first and second affixing flaps are made of fabric materials.

8. The child restraint device of claim 1, wherein the means for securing the rear panel to the changing surface includes one or more bands or flaps respectively attached the first side edge and the second side edge of the rear panel, or a hook or loop surface located on a back side of the rear panel adapted for attaching to a complementary loop or hook surface located on a front side of the changing surface.

9. A child restraint device for diapering a child, comprising:

a changing surface;

a first vest flap and a second vest flap each attached to the changing surface;

wherein the first vest flap has a multiple-sided shape with a first side attached along the changing surface along a transverse line of the changing surface, a third side attached to the changing surface along a first longitudinal line of the changing surface, and a second side between the first and third side forming an arm opening, wherein the second vest flap has a multiple-sided shape with a first side attached to the changing surface along the transverse line of the changing surface, a third side attached to the changing surface along a second longitudinal line of the changing surface, and a second side between the first and third side forming an arm opening, wherein the attachment locations of the first and second vest flaps along the transverse line of the changing surface are spaced apart from each other for accommodating a head of the child, and wherein the first and second vest flaps include means for attaching the first and second vest flaps together and means for securing the child restraint device comprising a first affixing flap and a second affixing flap attached along the first side edge and along the second side edge on the changing, surface, respectively,

10. The child restraint device of claim 9, wherein each of the first and second vest flaps includes a fourth side aligned with a second transverse line of the changing surface.

11. The child restraint device of claim 9, wherein the first vest flap and the second vest flap are made of fabric materials.

12. The child restraint device of claim 9, wherein the means for attaching the first and second vest flaps together includes complementary hook and loop surfaces, snaps, buttons, zippers, strings, or buckles, located on the first and second vest flaps.

* * * * *